US009677233B2

(12) United States Patent
Welch et al.

(10) Patent No.: US 9,677,233 B2
(45) Date of Patent: Jun. 13, 2017

(54) PEDESTRIAN BARRIER AND BARRIER SYSTEM

(71) Applicant: TRINITY HIGHWAY PRODUCTS LLC, Dallas, TX (US)

(72) Inventors: James B. Welch, Placerville, CA (US); Donald C. Pyde, Schaumburg, IL (US)

(73) Assignee: Trinity Highway Products LLC, Dallas, TX (US)

( * ) Notice: Subject to any disclaimer, the term of this patent is extended or adjusted under 35 U.S.C. 154(b) by 0 days.

(21) Appl. No.: 15/006,764

(22) Filed: Jan. 26, 2016

(65) Prior Publication Data

US 2016/0222611 A1 Aug. 4, 2016

Related U.S. Application Data

(60) Provisional application No. 62/110,073, filed on Jan. 30, 2015.

(51) Int. Cl.

| | |
|---|---|
| ***E01F 13/00*** | (2006.01) |
| ***E01F 13/02*** | (2006.01) |
| ***E01F 15/08*** | (2006.01) |

(52) U.S. Cl.

CPC ..... *E01F 13/022* (2013.01); *E01F 15/086* (2013.01)

(58) Field of Classification Search

CPC ..... E01F 13/022; E01F 15/086
USPC ..... 404/6, 9
See application file for complete search history.

(56) References Cited

U.S. PATENT DOCUMENTS

| | | | | |
|---|---|---|---|---|
| 4,681,302 | A | 7/1987 | Thompson | |
| 4,946,306 | A | 8/1990 | Yodock | |
| 5,104,254 | A | 4/1992 | Durand | |
| 5,123,773 | A | 6/1992 | Yodock | |
| 5,425,594 | A | 6/1995 | Krage et al. | |
| 5,452,963 | A * | 9/1995 | Christensen | E01F 13/022 256/13.1 |
| 5,531,540 | A | 7/1996 | Wasserstrom et al. | |
| 5,836,714 | A | 11/1998 | Christensen | |
| 5,882,140 | A | 3/1999 | Yodock, Jr. et al. | |
| 5,988,934 | A | 11/1999 | Wasserstrom | |
| 6,014,941 | A | 1/2000 | Bent et al. | |

(Continued)

FOREIGN PATENT DOCUMENTS

WO WO 2012/169907 A1 12/2012

OTHER PUBLICATIONS

Yodock® Traffic Control System Versatile Traffic Control Solutions, brochure, Yodock, prior to Jan. 30, 2015, 2 pages.

(Continued)

*Primary Examiner* — Raymond W Addie
(74) *Attorney, Agent, or Firm* — Brinks Gilson & Lione

(57) ABSTRACT

A pedestrian barrier system includes first and second barriers each having first and second sides, first and second ends, and an upper hand guide positioned along the first side. The first end of the first barrier is pivotally connected to the second end of the second barrier, wherein the first and second barriers are pivotable between at least a linear configuration wherein the first sides of the first and second barriers are co-planar and an orthogonal configuration wherein the first sides of the first and second barriers are perpendicular, and wherein the upper hand guide of the first and second barriers are continuous when the first and second barriers are in the linear and orthogonal configurations.

30 Claims, 8 Drawing Sheets

(56) References Cited

U.S. PATENT DOCUMENTS

| | | | | |
|---|---|---|---|---|
| 6,059,491 | A * | 5/2000 | Striefel | E01F 15/086 256/13.1 |
| 6,086,285 | A | 7/2000 | Christensen | |
| 6,190,084 | B1 * | 2/2001 | Ibanez | E01F 13/02 160/351 |
| 6,203,242 | B1 | 3/2001 | Englund | |
| 6,428,237 | B1 | 8/2002 | Duckett | |
| 6,676,113 | B2 | 1/2004 | Christensen et al. | |
| 6,807,911 | B2 | 10/2004 | Carson et al. | |
| 6,951,434 | B2 | 10/2005 | Yodock, Jr. et al. | |
| 7,275,888 | B1 | 10/2007 | Christensen et al. | |
| 7,416,364 | B2 | 8/2008 | Yodock, III et al. | |
| 7,445,403 | B2 | 11/2008 | Williams et al. | |
| 7,537,411 | B2 | 5/2009 | Yodock, Jr. et al. | |
| 7,540,682 | B1 * | 6/2009 | Christensen | E01F 13/022 116/63 P |
| D596,062 | S | 7/2009 | Yodock, III et al. | |
| 7,588,387 | B1 * | 9/2009 | Christensen | E01F 15/083 256/13.1 |
| 7,600,942 | B2 | 10/2009 | Yodock, III et al. | |
| 7,618,212 | B2 | 11/2009 | Yodock, III et al. | |
| D614,984 | S | 5/2010 | Christensen et al. | |
| 7,789,585 | B2 | 9/2010 | Christensen et al. | |
| 7,922,420 | B2 | 4/2011 | Christensen et al. | |
| D665,689 | S | 8/2012 | Mettler et al. | |
| 8,235,625 | B1 | 8/2012 | Kulp et al. | |
| 8,302,937 | B2 | 11/2012 | Mettler et al. | |
| 8,313,265 | B2 | 11/2012 | Taylor | |
| 8,376,651 | B2 | 2/2013 | Kulp et al. | |
| 8,453,995 | B2 | 6/2013 | Christensen et al. | |
| 8,783,999 | B2 | 7/2014 | Kulp et al. | |
| 8,864,411 | B2 | 10/2014 | Taylor | |
| 2003/0219308 | A1 | 11/2003 | Boulais et al. | |
| 2004/0057791 | A1 | 3/2004 | Bruyere et al. | |
| 2009/0060650 | A1 | 3/2009 | Kulp et al. | |
| 2010/0129156 | A1 | 5/2010 | Taylor | |
| 2010/0215427 | A1 | 8/2010 | James | |
| 2012/0076588 | A1 * | 3/2012 | Dupuis | F01M 11/03 405/107 |
| 2012/0297589 | A1 | 11/2012 | James et al. | |

OTHER PUBLICATIONS

TrafFix Devices Inc., San Clemente, CA, ADA™ Wall, Creating a Continuous Hand guided Safe Passage Through the Workzone, brochure, www.traffixdevices.com, prior to Jan. 30, 2015, 2 pages.

Plastic Safety Systems, Inc., Cleveland, OH, SafetyWall™ ADA-Compliant Pedestrian Barricade, brochure, www.plasticsafety.com, © dated 2011, two pages of 11.

Plastic Safety Systems, Inc., Cleveland, OH, SafetyRail™ ADA-Compliant Pedestrian Barricade, brochure, © dated 2011, 2 pages of 11.

OTW Safety Innovators in Safety and Security Barricades, brochure, www.itwsafety.com, prior to Jan. 30, 2015, 4 pages.

* cited by examiner

PEDESTRIAN BARRIER AND BARRIER SYSTEM

This application claims the benefit of U.S. Provisional Application No. 62/110,073, filed Jan. 30, 2015, the entire disclosure of which is hereby incorporated herein by reference.

FIELD OF THE INVENTION

The present invention relates generally to a pedestrian barrier and barrier system, and to methods for the use and assembly thereof.

BACKGROUND

One challenge, faced during the construction of roads, buildings, and other similar structures, is the need to safely perform the work while allowing traffic and pedestrians access to surrounding facilities. In an urban environment, this may mean providing for pedestrian traffic adjacent to such construction. It may also be important to allow vehicle traffic continued access to roadways undergoing or adjacent to such construction. In each of these situations, the pedestrians or vehicles may need to be guided onto portions of the roadway which may not normally be used for pedestrian or vehicle traffic, such as the area used for parking or opposing vehicle lanes. To safely do this, vehicles and pedestrians need to be channeled and guided into and onto the new pathway. Furthermore, in instances where pedestrians and vehicles are using adjacent pathways, the pedestrians and vehicles need to be separated to ensure that there are no pedestrian/vehicle encounters and conflicts.

A variety of devices have been used to provide pedestrian/vehicle separation, including cones, drums, and stanchions connected with chains or ropes. One system that provides effective separation is a continuous line of barriers known as Longitudinal Channelizing Devices (LCDs). LCDs provide a continuous line of demarcation between where the vehicles should travel and where the pedestrians should walk. A typical LCD may be configured as a short barrier that may be connected to an adjacent barrier, via a pin, or similar type of connector. Additional barriers may be added to define a continuous barrier system. The connection between barriers ensures that the barriers remain connected should they be bumped or jostled. Compliance at the joints between adjacent barriers may allow the barrier system to follow a curved or curvilinear path. Typically, it is desirable to provide LCDs with high visibility, for example by configuring the LCDs with bright, contrasting colors, such as orange and white. To maintain their position, LCDs may be ballasted with water or sand.

LCDs may be used in situations where there is vehicular traffic on one side and pedestrians on the other, or with vehicular traffic on both sides. In situations where pedestrians are passing along one side of the barrier, the barrier needs to be designed to accommodate the diverse needs of pedestrians, as called for in the Americans with Disabilities Act Accessibility Guidelines (ADAAG) and the Manual on Uniform Traffic Control Devices (MUTCD). For example, an individual who is sight impaired may need a continuous hand rail along the top of the barrier, regardless of whether the barrier system follows a straight or curvilinear path.

A sight impaired person who uses a cane may also require a continuous vertical surface near the ground, again regardless of whether the barrier system follows a straight or curvilinear path. For example, the MUTCD calls for continuous bottom and top surfaces that are detectable to users of long canes. The bottom surface needs to be no higher than 2 inches above the ground and the top surface needs to be no lower than 32 inches above the ground. The MUTCD also states that the barrier needs to provide a continuous vertical surface up to at least 6 inches above the ground.

Some barriers are configured with an internal steel frame, and/or with an external steel cables and steel connector pins. Such configurations may be expensive to manufacture. Some barriers may also have limited compliance at the joint between adjacent barriers, which precludes use of the system along a curved pathway, especially where the curvature is defined by a small radius.

Other devices may have better joint compliance, but fail to provide continuity along a top surface, or to provide to provide a continuous vertical surface near the ground, when deployed in an articulated configuration, for example along a curvilinear path. Other barriers may provide a continuous upper surface to act as a hand guide, as well as a continuous vertical surface near the ground, but are not self-ballasted, meaning the barriers may be easily displaced once deployed. Some barriers may be ballasted with sand, but are difficult to empty after use, and barriers relying on sand bags for ballast are messy and subject to tampering.

SUMMARY

The present invention is defined by the following claims, and nothing in this section should be considered to be a limitation on those claims.

In one aspect, one embodiment of a pedestrian barrier system includes first and second barriers each having first and second sides, first and second ends, and an upper hand guide positioned along the first side. The first end of the first barrier is pivotally connected to the second end of the second barrier. The first and second barriers are pivotable between at least a linear configuration wherein the first sides of the first and second barriers are co-planar and an orthogonal configuration wherein the first sides of the first and second barriers are perpendicular. The upper hand guides of the first and second barriers are continuous when the first and second barriers are in the linear and orthogonal configurations. Various methods of using and assembling the barrier system are also provided.

In another aspect, one embodiment of a method of assembling a pedestrian barrier system includes pivotally connecting first and second ends of adjacent barriers, wherein the pivotally connected adjacent barriers are pivotable between at least a linear configuration wherein the first sides of the pivotally connected barriers are co-planar and an orthogonal configuration wherein the first sides of the pivotally connected barriers are perpendicular, and wherein the upper hand guide of the pivotally connected barriers are continuous when the pivotally connected barriers are in either of the linear and orthogonal configurations. The method also may include filling the barriers with a fluid.

In another aspect, one embodiment of a pedestrian barrier includes a body defining an internal cavity adapted to hold a fluid and a filling port communicating with the internal cavity. The body includes first and second sides, first and second ends, and an upper hand guide positioned along the first side. The upper hand guide is continuous between the first and second ends. The first side is longer than the second side. The first end of the body includes a first pivotal connection arrangement and the second end of the body includes a second pivotal connection arrangement different than the first pivotal arrangement. The first side of body includes a flat, vertical surface extending between about 2 and about 6 inches from a ground engaging portion of the body, wherein the flat, vertical surface is continuous between the first and second ends.

The various embodiments of the barrier, barrier system and methods of using and assembling the barrier system, provide significant advantages over other barriers and barrier systems. For example and without limitation, the barriers may be arranged in linear and non-linear configurations while maintaining continuous upper hand rails and lower flat portions. In addition, the barriers may be filled with a fluid ballast, which may be easily and quickly supplied and withdrawn, such that they are capable of withstanding significant impacts and are not easily displaced or tampered with. The pivotal connection arrangements provide for easy and quick assembly, while the mating upper rail and bottom recess provide for easy and secure stacking of the barriers for transportation and storage.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
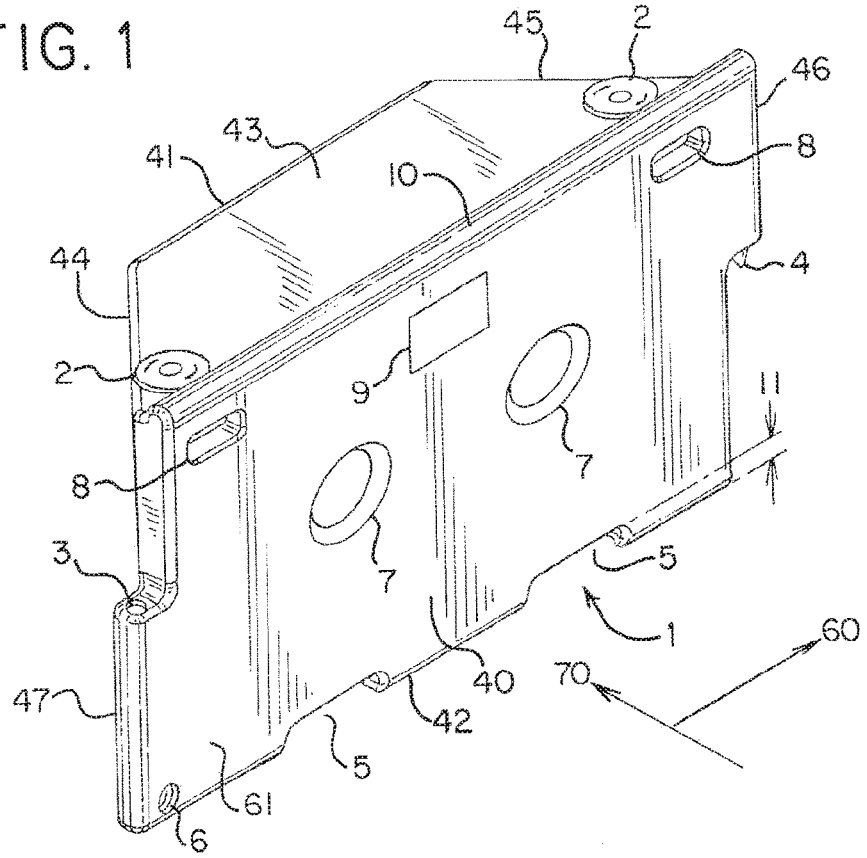
FIG. 1 is a perspective view of one embodiment of a barrier.

It should be understood that the term "longitudinal," as used herein means of or relating to length or the lengthwise direction 60 of a barrier and/or barrier system. The term "lateral," as used herein, means directed toward or running perpendicular to the side of the barrier, in a sideways direction 70 or side-to-side of the barrier. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" barriers may refer to any sequence of such barriers, and is not limited to the first and second adjacent barriers sections unless otherwise specified. The term "continuous" means substantially uninterrupted, and with any gaps, breaks or other discontinuities in the feature or component so described being 2 inches or less. The term curvilinear refers to a non-linear array, whether configured with linear segments that are not axially aligned, or with curved segments.

Referring to FIGS. 1, 2, 3 and 13-17, one embodiment of a barrier 1 includes a body having a non-traffic wall/side 40, a traffic wall/side 41, a top wall/surface 43, a bottom wall/surface 42, and angled end walls 44 and 45. When viewed from above, the body has a trapezoidal shape, with the non-traffic side 40 being longer in the longitudinal direction 60 than the traffic side 41. The various walls 40, 41, 44 and 45 provide for continuous, flat vertical surfaces on both the pedestrian and traffic sides of the barrier 1. These surfaces provide improved visibility, and provide increased surface area for other indicia to be applied, such as warning indicia, including various reflective tape, signage, etc.

Fill ports 2 are provided in the top wall 43 of the body 1 to allow water, or other fluid, to be added to an internal cavity of the body as ballast. The cavity may be defined by the walls 40, 41, 43 42, 44 and 45. Drain ports 6 are provided in one or more of a non-traffic wall 40, traffic wall 41 or bottom wall to allow the barrier 1 to be drained of any ballast that has been added to the internal cavity. Both the fill ports 2 and drain ports 6 are provided with closures or plugs to seal the barrier 1 and maintain the level of fluid as ballast.

Although in most cases the ballast fluid will be water, in other applications, for instance in cold weather applications, the fluid may be a mixture of water and common salts, such as sodium chloride, magnesium chloride or potassium acetate, or may include other various anti-freeze ingredients. Water is the most effective form of ballast as it is readily available and it can easily be drained and disposed of when the barriers need to be moved. In one embodiment, the ballast includes between 80 and 85 gallons of water or other fluid, although some embodiments may have more or less ballast, depending upon the application. In one embodiment, the empty weight of the barrier 1 is between 25 and 50 lbs, making it easy for one person to move, however other embodiments may have more or less weight. One embodiment of the barrier is made from linear low density polyethylene, although other plastics, polymeric materials, or composite materials may be used.

Figure 3:
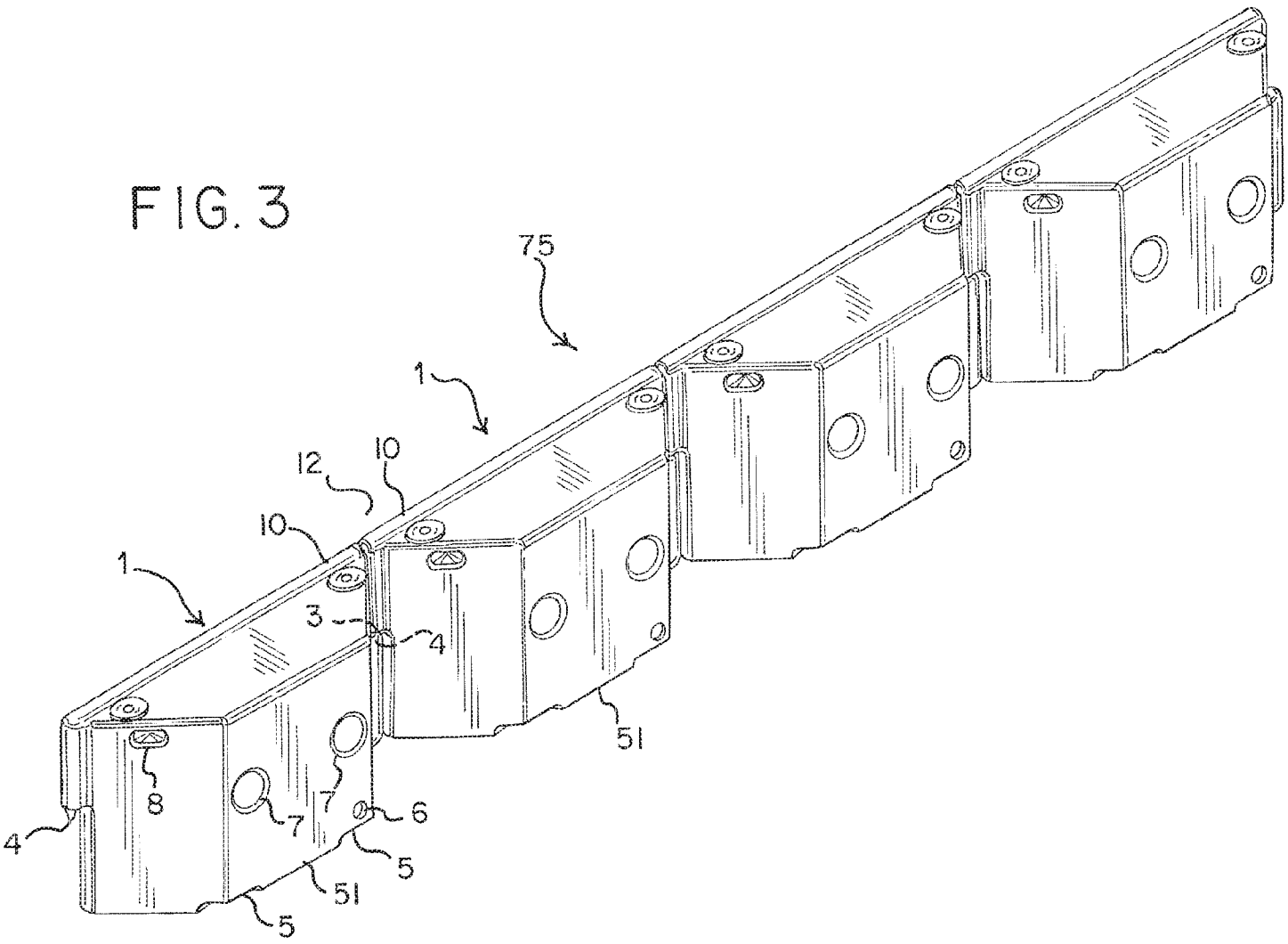
FIG. 3 is a traffic side perspective view of one embodiment and configuration of a barrier system.
Figure 4:
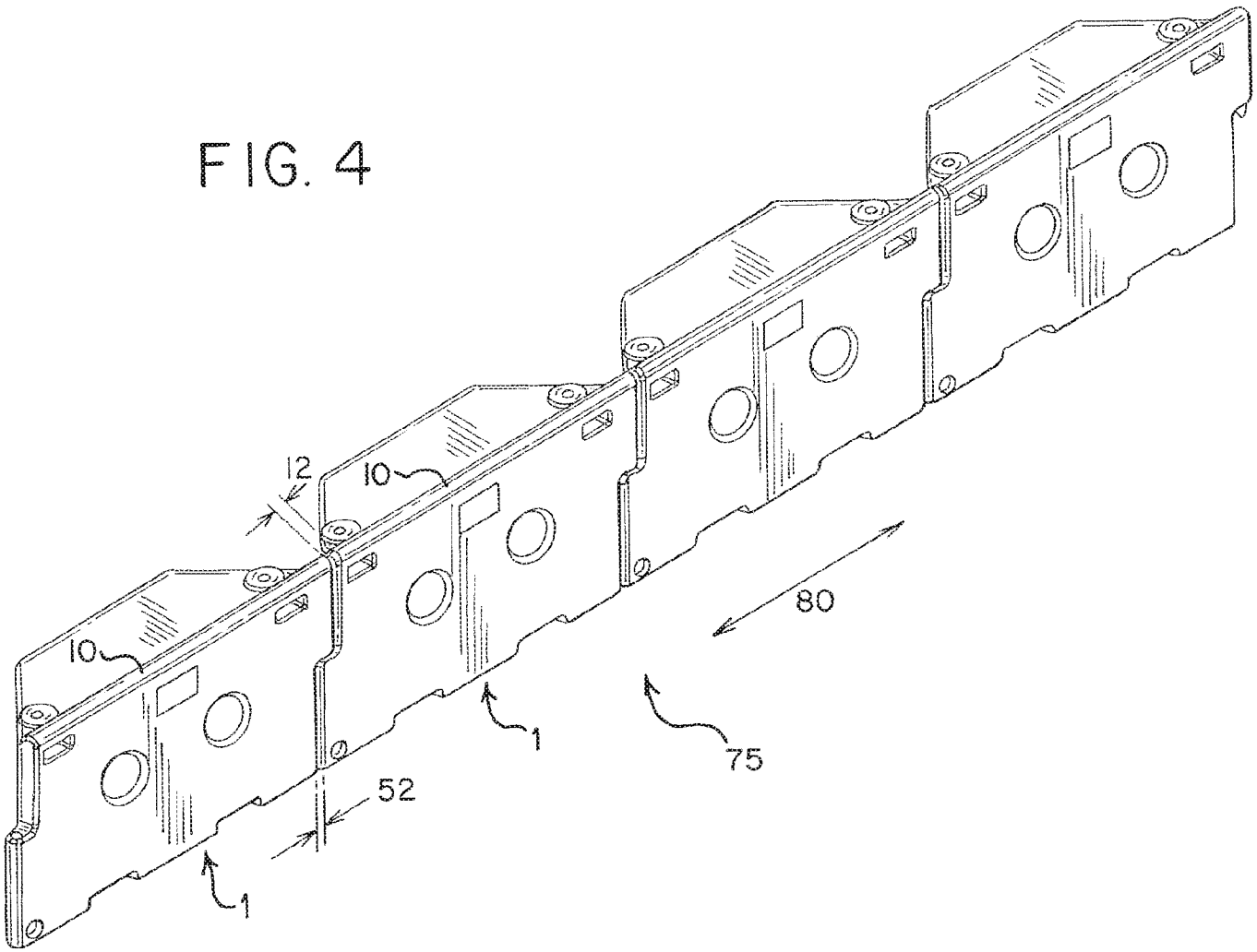
FIG. 4 is a traffic side perspective view of the barrier system shown in FIG. 3.

The body is configured with a top knuckle 46 defining one end of the body and a bottom knuckle 47 defining an opposite end of the body. The knuckles allow adjacent barriers 1 to be placed next to each other and joined to form a compliant joint. In one embodiment, adjacent barriers 1 are joined together by way of first and second connector arrangements, configured in one embodiment as a pin 4 in top knuckle 46 and a socket 3 in bottom knuckle 47. It should be understood that the pin and socket may be reversed, with the pin extending upwardly from the bottom knuckle and the socket formed in the top knuckle. In one embodiment an end portion of the pin 4 is tapered along at least one side, for example having a taper angle $\alpha$. The taper facilitates the assembly of the adjacent barriers in a barrier system, as is shown in FIGS. 3 and 4, as the pin is more easily inserted in socket 3. The pin and socket are also self-aligning.

The pivotal connection also allows for adjacent barriers to be more easily pulled apart when they are empty of ballast. This is done by pulling the barriers in a longitudinal direction 60, with little or no upwards force being required to separate the barriers due to the angle of the pin surface. The angle $\alpha$ in one embodiment is preferably between 10 and 20 degrees, and more preferably about 15 degrees. The bore of socket 3 matches the angle of the pin 4, as shown by the hidden lines in FIG. 2. It should be understood that while the pin is integrally formed with the body, it may be separately formed and installed in other embodiments, and may be configured as a cylinder (tubular or solid), or have other cross-sectional shapes. In addition, while only a single pin is shown as being used at each joint, it should be understood that more than one pin may be used, and/or that other connection systems such as straps, plates, and fasteners may also be used to join adjacent barriers. As shown, the entire barrier 1 may be integrally formed as a single unit, including the connector components, which simplifies storage, transportation and assembly. Adjacent devices may be easily and quickly secured one to the other without tools. In addition, each barrier is self-supporting and free standing, meaning the barrier does not have to be connected to adjacent barriers, or require additional supports. As such, the barriers may be positioned in an array where two or more adjacent barriers are separated, with gaps formed therebetween. An array of separated, free-standing barriers may be slightly longer than an array of connected barriers.

Fork lift ports 5 are provided in the body to allow the barrier 1 to be easily lifted and moved with a fork lift, regardless of whether the barrier is full of ballast or empty. The height of fork lift ports 5 is noted with dimension 11. Next to fork lift ports 5 on each end of non-traffic face 40 are stacking cutouts or recesses 51, the height of which are noted by dimension 49. Dimensions 11 and 49 are preferably less than or equal to 2 inches to meet the requirements of the ADAAG and MUTCD.

Figure 2:
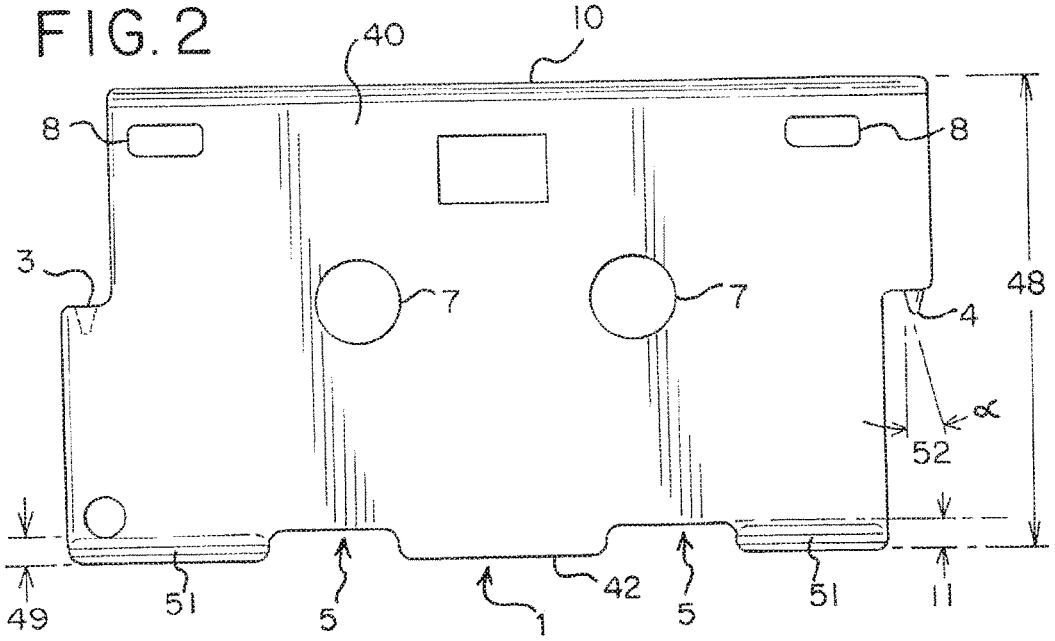
FIG. 2 is a first non-traffic side view of the barrier shown in FIG. 1.
Figure 17:
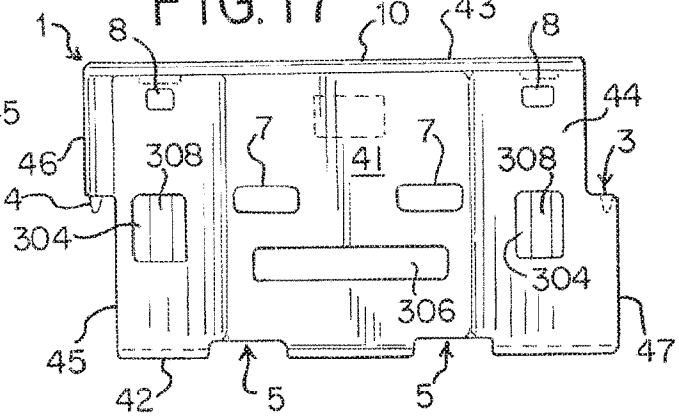
FIG. 17 is a traffic side view of the barrier shown in FIG. 13.
Figure 16:
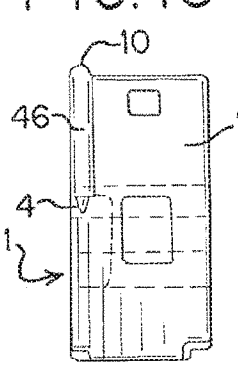
FIG. 16 is an end view of the barrier shown in FIG. 13.
Figure 15:
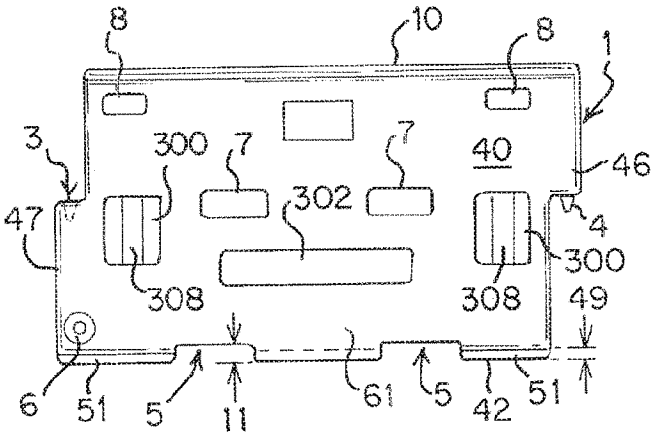
FIG. 15 is a non-traffic side of the barrier shown in FIG. 13.

Through ports 7 are provided in the body to join the non-traffic wall or side 40 and the traffic wall or side 41 together, providing extra strength and structure to barrier 1. Through ports 7 also may be used by a fork lift to move the barriers, particularly when the barriers are empty of ballast. For example, the through ports 7 may be made with a rectangular shape as shown in FIGS. 15 and 17 to accommodate the forklift prongs, and allow for the insertion thereof. As shown in FIGS. 1 and 2, the through ports 7 may be circular. It should be understood that the through ports may have other shapes as deemed suitable for a particular use. Hand holds 8 are provided in the non-traffic wall 40 and the angled end walls 44 and 45 to facilitate moving the barrier 1. Name plate 9 is provided on the barrier 1 to display pertinent information, such as the name of the barrier 1, date of manufacture, manufacturer's and/or owner's name, patent notification information, etc. Although the name plate 9 is shown on the non-traffic wall 40, it may be located on one or more of the top wall 43, traffic wall 41, end walls 44 and 45, or bottom wall.

Referring to FIGS. 13-17, a plurality of struts may also be incorporated into the barrier. The struts are each formed by recessed pockets 300, 302, 304, 306, or indentations, joining and extending inwardly from each of the traffic and non-traffic sides 40, 41, with interior, abutting surfaces 310, 312, 314 of the pockets being joined. The struts are disposed in, and extend interiorally across the cavity. The struts provide additional strength and resist bulging of the sides 40, 41 due to the internal head pressure from the fluid. As shown, the barrier includes three struts formed by pockets 300, 304 and 302, 306, two struts (300, 304) positioned on opposite sides of the through ports, and one strut (302, 306) formed by pockets positioned below the through ports. In general, at least a portion of the struts are provided in the lower portion of the barrier (e.g., lower half or lower ⅔ of the barrier) where the head pressure is the greatest. It should be understood that more or fewer than the three illustrated struts may be incorporated into the barrier.

An upper hand guide 10 is provided on the body at the juncture of top wall 43 and non-traffic wall or side 40, to allow pedestrians to be supported and guided by the barrier 1. The height of the hand guide 10, and in particular the upper surface thereof, relative to a bottom ground engaging surface 42 is delineated by guide height 48. Although a variety of barrier designs are possible, depending upon the applications, the barrier 1, and height of the upper surface of the hand guide 10, is preferably no less than 32 inches from the ground, or a ground engaging surface 42 of the body, in order to conform to the requirements of the MUTCD. In one embodiment, the dimension of the hand guide 10 is greater or equal to 32 inches and less than or equal to 35 inches.

Referring to FIGS. 3 and 4, an array of barriers 1 may be connected together to form a barrier system or string 75 to delineate a pedestrian pathway 80. When connected together, the hand guides of the pivotally connected barriers form a continuous hand guide. For example, a barrier gap 12 may be formed between adjacent hand guides 10 of adjacent, pivotally connected barriers. The barrier gap 12 needs to be as small as possible so that a pedestrian that is being guided by the barrier system 75 may grasp and feel the continuous hand guide defined by the barrier system as the user travels along the delineated pedestrian pathway 80. As defined above, the gaps 12 formed in the continuous hand guide are each less than or equal to 2 inches and more preferably less than or equal to 1 inch. In this way, a pedestrian may grasp both barriers at the same time, with their hand bridging the gaps 12. The barrier system 75 may also have a lower gap 52 formed between barriers. The lower gap 52 needs to be as small as possible so that a pedestrian using a cane can sense adjoining barriers and does not become confused by a large gap. The lower gap 52 is less than or equal to 2 inches and more preferably 1 inch or less.

Ideally the pedestrian side edge of the hand guide at the top of the barrier is in the same vertical plane as a cane guide portion 61 which is close to the ground. In one embodiment, the non-traffic wall/side is substantially planar, e.g., a vertical plane, and extends from a bottom edge, defined by one or more of the ports 5, the bottom wall 42 or the top of recess 51, to the upper hand guide. The cane guide portion is defined by a flat, vertical surface extending from 2 inches or less to at least 6 inches or more from the ground engaging portion 42 of the body of the barrier. It should be understood that the cane guide portion may extend upwardly higher than 6 inches. The cane guide portion 61, or flat, vertical surface is continuous between the first and second ends of the body of the barrier and is continuous in the longitudinal direction 60 along a plurality of barriers pivotally connected in a barrier system.

Figure 5:
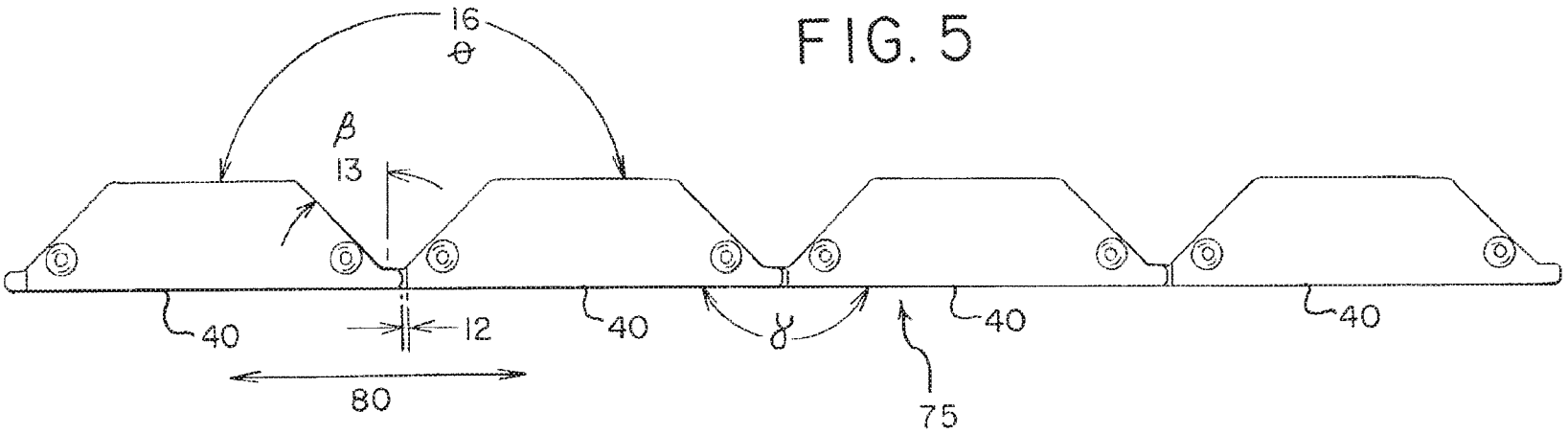
FIGS. 5-7 are top views of different barrier system embodiments.
Figure 6:
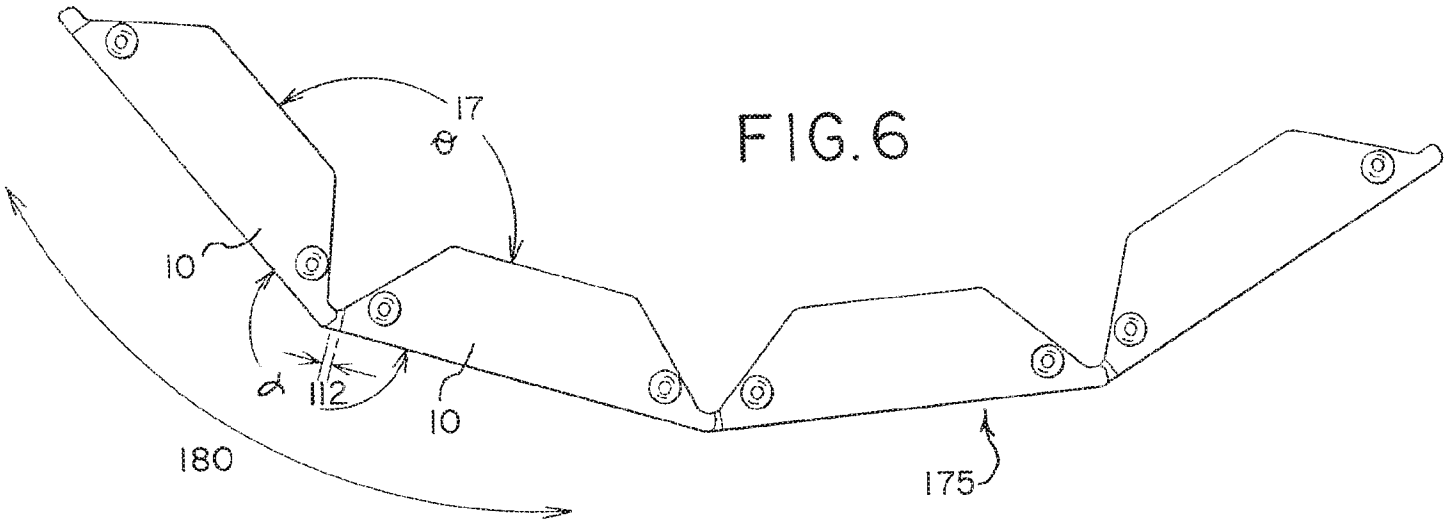
Figure 7:
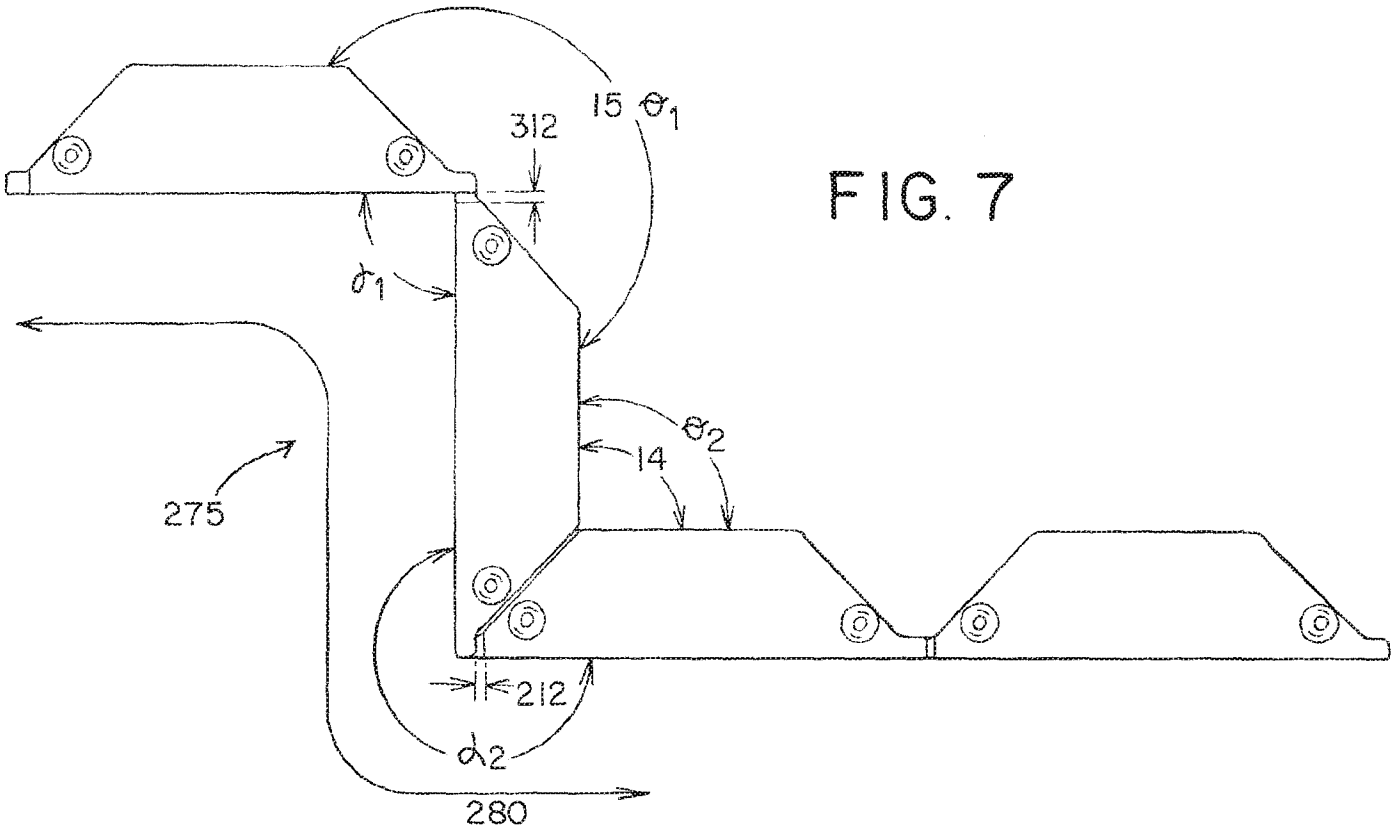

Referring to FIGS. 5, 6, and 7, the angled end walls of the body of the barrier form an angle $\beta$ relative to plane running perpendicular to the sides 40, 41. In one embodiment, the angle $\beta$ is preferably about 45 degrees, although different embodiments of barriers may have greater or lesser end wall angles, depending upon the application.

In FIG. 5, the barrier system 75 is arranged in a linear configuration, with the sides 40 defining a straight line following the straight pedestrian pathway 80. Thus the angles θ, γ between adjacent barriers is about 180 degrees. Referring to FIG. 6, the pedestrian pathway 180 is not straight, but rather follows a continuous curve, or is curvilinear. In this embodiment, the barrier system 175 follows curved pedestrian pathway 180 and the barrier angle θ is somewhat less than 180 degrees (between 180 and 90 degrees, while the angle γ between the opposite sides of adjacent barrier is greater than 180 degrees (between 180 and 270 degrees).

FIG. 7 shows barrier system or string 275 forming two right angles to follow pedestrian pathway 280, with the sides 40 pivoted to an orthogonal configuration. In this embodiment, barrier angle θ1 is about 270 degrees and barrier angle γ1 is about 90 degrees, while angle θ2 is about 90 degrees and angle γ2 is about 270 degrees. At either corner, the adjacent barriers may be positioned orthogonal to each other while leaving a clear area, free of any obstructions, on the opposite side. In this configuration there are two barrier gaps 212 and 312, both of which are preferably less than or equal to 2 inches and more preferably 1 inch or less. In this way, a pedestrian may grasp both barriers at the same time, with their hand bridging the gaps 212, 312. Of course it should be understood that some pedestrian pathways could require barrier angle θ1 to be greater than 270 degrees. It should also be understood that some barrier designs will have end wall angles greater than 45 degrees and thus barrier angle θ2 may be less than 90 degrees, depending upon the application. The pivotal connection between adjacent first and second ends of first and second barriers allows for the barriers to be pivoted relative to each other between at least the linear configuration (FIGS. 5 and 7) wherein the first sides 40 of at least a first and second barrier are co-planar (180 degrees) and an orthogonal configuration (FIG. 7) wherein the first sides 40 of at least a first and second barrier are perpendicular (whether 90 degrees or 270 degrees). In either configuration, the upper hand guides of the first and second barriers are continuous when the first and second barriers are in either of the linear and orthogonal configurations. As disclosed, the barriers may be arranged at an infinite number of other angles θ, γ relative to each other between the linear and orthogonal configurations to accommodate any configuration of pathway.

Figure 8:
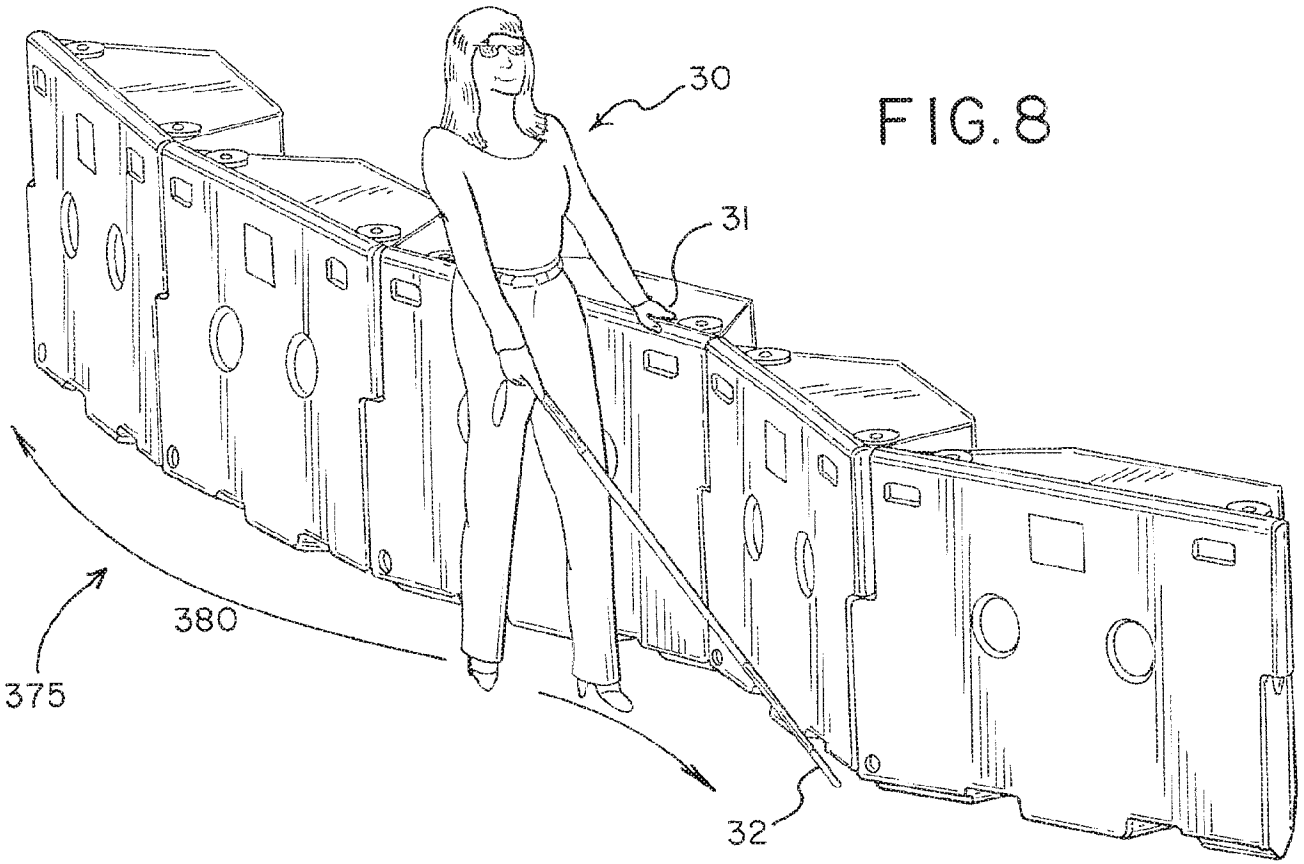
FIG. 8 is a perspective view of sight impaired user being guided by one embodiment of a barrier system.

FIG. 8 shows a pedestrian 30 following a curvilinear pedestrian pathway 380. Barrier system or string 375 is not straight, but rather has modest angles formed between barriers 1 to allow the barrier system 375 to follow the pedestrian pathway 380. The pedestrian 30 may use her hand 31 to help guide her along the continuous hand guide and barrier system 375 and thus down pedestrian pathway 380. Likewise pedestrian 30 may use her cane 32 to engage the flat surface, or cane guide portion 61, enabling her to locate and sense the barrier system 375 as she walks down pathway 380.

Figure 9:
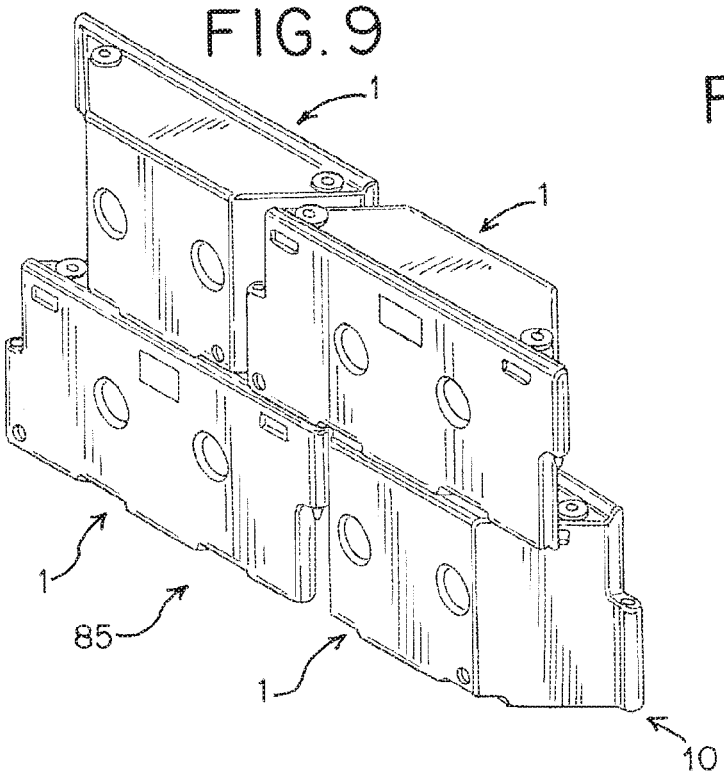
FIG. 9 is a perspective view of a plurality of barriers in a stacked configuration.
Figure 10:
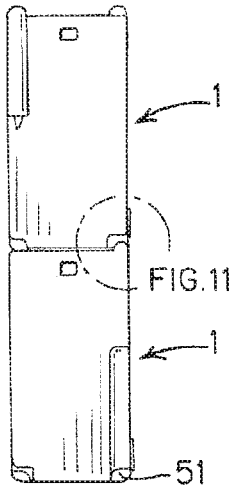
FIG. 10 is and end view of stacked barriers shown in FIG. 9.
Figure 11:
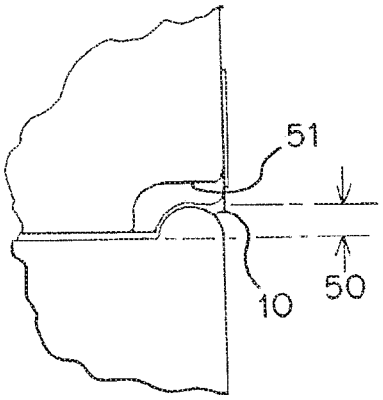
FIG. 11 is an enlarged partial view of the barriers taken along line 11 of FIG. 10.

Referring to FIGS. 9, 10, and 11, some embodiments of barriers 1 have features that allow them to be neatly stacked in stacked array 85 for storage or transport. Referring to FIG. 11, the hand guide 10, which extends upwardly from the top wall or upper surface, fits into stacking cutouts or recesses 51 so that the barriers nest together into a stable stacked array 85. Stacking cutouts 51 may be provided on both the non-traffic wall 40 and the traffic wall 41, so that the hand guide 10 fits into the appropriate stacking cutout 51, no matter which way the barrier 1 is oriented in the stack. In this way, the hand guide 10 functions to guide the hand of the user when the barrier is in use, and functions as a stacking guide when the barriers are being stored and/or transported.

Figure 12:
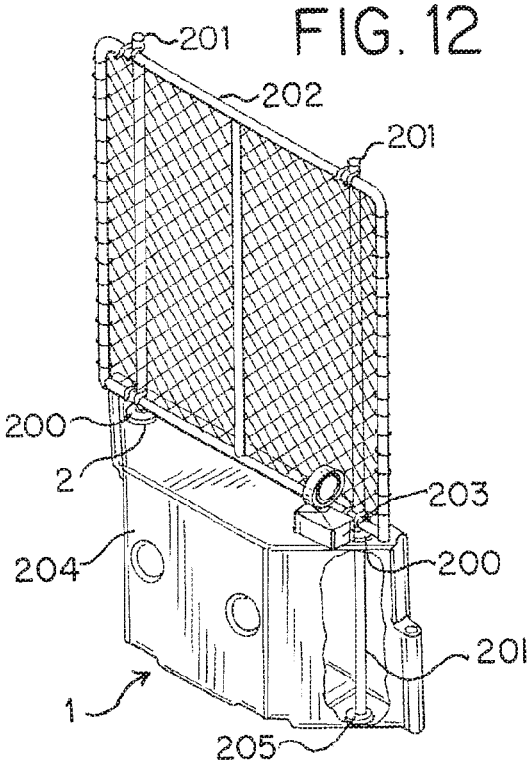
FIG. 12 is a perspective view of another barrier shown in partial cut-away.
Figure 13:
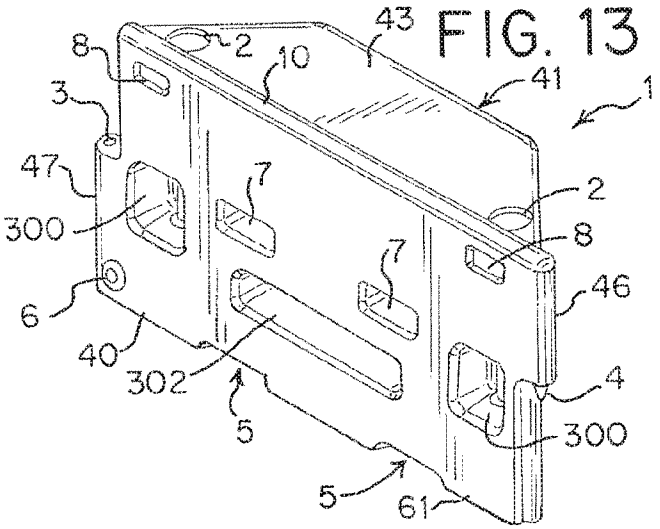
FIG. 13 is a perspective view of another embodiment of a barrier.
Figure 14:
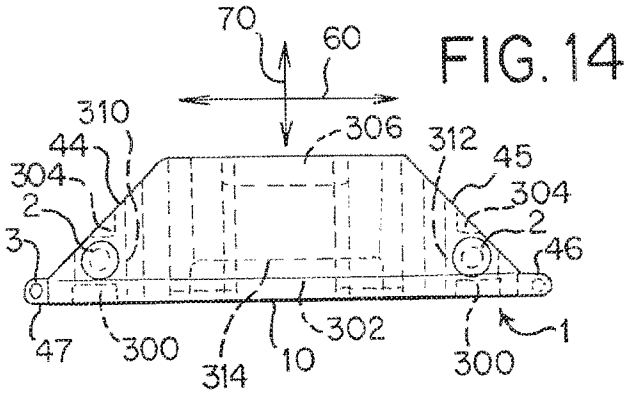
FIG. 14 is a top view of the barrier shown in FIG. 13.

Referring to FIG. 12, some embodiments of barriers 1 have supplementary features that increase or improve their functionality when used as traffic or pedestrian barriers. For example, barrier 1 may be configured with fill port plugs 200 that cover a portion of fill ports 2 and have a central hole through which posts 201 may be disposed in a sealed relationship. Posts pass through the internal cavity of barrier 1 and are supported and constrained by barrier insets 205 at the bottom of the cavity of barrier 1. In the embodiment of FIGS. 13-17, the struts formed on the sides include cylindrical sleeve portions 308, with vertical through openings, that capture and support the posts 201. Posts 201 can support a variety of supplementary features or components for the barrier 1, including without limitation a pedestrian fence 202, which prevents pedestrians from climbing over barrier 1. In one embodiment, the pedestrian fence 202 is constructed of chain link fence material, supported by hollow round tubes. In other embodiments, the posts 201 may support an opaque barrier, or glare screen, which serves primarily to prevent glare from vehicle headlights from blinding pedestrians that are on the opposite side of barrier 1. As shown in FIG. 12, the pedestrian fence, posts, glare screens or other barriers are laterally offset from the hand guide 10 so as to not confuse visually impaired users. In, addition, the offset of the fences, posts, screens, etc. improves the stability of the barrier, which may be susceptible to wind or other environmental conditions applied to either or both sides of the component.

As shown in FIG. 12, warning indicia, such as one or more warning lights 203 may also be added to posts 201, or to barrier 1 itself, to warn oncoming motorists of the presence of the barrier 1. Likewise, warning indicia, such as one or more reflectors 204 may be added to either the traffic or pedestrian sides of barrier 1 to improve the visibility of the barrier, to either motorists or pedestrians. In one embodiment, the warning indicia, or reflector 204, is made from a high intensity retroreflective tape. Although a narrow band of tape is shown in FIG. 12, other embodiments have several bands of retroreflective tape, or a continuous sheet of retroreflective tape. Other signage, including warning signs or advertising, may be secured to the barrier.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A pedestrian barrier system comprising:

first and second barriers each having first and second sides, first and second ends, and an upper hand guide positioned along said first side, wherein said first and second barriers each have a trapezoidal shape when viewed from above, wherein said first end of said first barrier is pivotally connected to said second end of said second barrier, wherein said first and second barriers are pivotable between at least a linear configuration wherein said first sides of said first and second barriers are co-planar and an orthogonal configuration wherein said first sides of said first and second barriers are perpendicular, wherein said first and second barriers each comprise an internal cavity adapted to hold a fluid, and wherein said upper hand guide of said first and second barriers are continuous when said first and second barriers are in said linear and orthogonal configurations.

2. The pedestrian barrier system of claim 1 wherein said first side of each of said first and second barriers comprises a flat, vertical surface extending from 2 inches or less to at least 6 inches relative to a ground engaging portion of said first and second barriers, and wherein said flat, vertical surfaces of said first and second barriers are continuous between said second end of said first barrier and said first end of said second barrier when said first and second barriers are in said linear and orthogonal configurations.

3. The pedestrian barrier system of claim 1 wherein said first and second barriers each comprise a filling port communicating with said internal cavity.

4. The pedestrian barrier system of claim 1, wherein an upper surface of said upper hand guide is positioned from 32 inches or greater to 35 inches or less relative to said ground engaging portion.

5. The pedestrian barrier system of claim 1, wherein a gap between adjacent upper hand guides is less than or equal to about 2 inches when said first and second barriers are in said linear and orthogonal configurations.

6. The pedestrian barrier system of claim 5 where said gap is less than or equal to about 1 inch when said first and second barriers are in said linear and orthogonal configurations.

7. The pedestrian barrier system of claim 1 where said first and second barriers comprise a low density polyethylene.

8. The pedestrian barrier system of claim 2 where an edge of said upper hand guide is contained with a plane defined by said flat, vertical surface.

9. The pedestrian barrier of claim 1 wherein one or more warning indicia is applied to said first or second barriers.

10. The pedestrian barrier system of claim 1 wherein said upper hand guide extends upwardly from a top surface of each of said first and second barriers and wherein each of said first and second barriers comprises a recess formed in a bottom along said first side, wherein said recess is shaped to receive said upper hand guide.

11. The pedestrian barrier system of claim 2 wherein said first end of said first barrier comprises a vertically extending pin and said second end of said second barrier comprises a socket shaped to receive said pin.

12. The pedestrian barrier system of claim 11 wherein said pin comprises a tapered end portion.

13. The pedestrian barrier system of claim 1, wherein said first and second barriers meet or exceed the impact requirements of the Manual for Assessing Safety Hardware (MASH) as a longitudinal channelizing device.

14. The pedestrian barrier of claim 1 wherein a post is disposed through a top wall of said first or second barrier into said internal cavity defined by said first or second barrier.

15. The pedestrian barrier of claim 14 wherein a fence is secured to said post.

16. The pedestrian barrier of claim 14 wherein the post is sealed at an interface with said top wall.

17. The pedestrian barrier of claim 14 wherein a bottom of said post is supported by a bottom wall of said first or second barrier.

18. A pedestrian barrier comprising:

a body defining an internal cavity adapted to hold a fluid and a filling port communicating with said internal cavity, said body comprising first and second sides, first and second ends, and an upper hand guide positioned along said first side, wherein said upper hand guide is continuous between said first and second ends, wherein said first side is longer than said second side, wherein said first end of said body comprises a first pivotal connection arrangement and said second end of said body comprises a second pivotal connection arrangement different than said first pivotal arrangement, and wherein said first side of said body comprises a flat, vertical surface extending from 2 inches or less to at least 6 inches from a ground engaging portion of said body, wherein said flat, vertical surface is continuous between said first and second ends.

19. The pedestrian barrier of claim 18, wherein said body has a trapezoidal shape when viewed from above.

20. The pedestrian barrier of claim 18, wherein an upper surface of said upper hand guide is positioned from about 32 inches or more to about 35 inches or less relative to said ground engaging portion.

21. The pedestrian barrier of claim 18, wherein an edge of said upper hand guide is contained with a plane defined by said flat, vertical surface.

22. The pedestrian barrier of claim 18, wherein said upper hand guide extends upwardly from a top surface of said body and wherein said body comprises a recess formed in a bottom thereof along said first side.

23. The pedestrian barrier of claim 18, wherein said first pivotal connection arrangement comprises a vertically extending pin and said second pivotal connection arrangement comprises a socket.

24. The pedestrian barrier of claim 18 wherein a post is disposed through a top wall of said body into said internal cavity.

25. The pedestrian barrier of claim 24 wherein a fence is secured to said post.

26. The pedestrian barrier of claim 23 wherein said pin comprises a tapered end portion.

27. The pedestrian barrier of claim 24 wherein said post is sealed at an interface with said top wall.

28. The pedestrian barrier of claim 24 wherein a bottom of said post is supported by a bottom wall of said first or second barrier.

29. The pedestrian barrier of claim 18 wherein one or more warning indicia is applied to said body.

30. The pedestrian barrier of claim 18, wherein said body meets or exceeds the impact requirements of the Manual for Assessing Safety Hardware (MASH) as a longitudinal channelizing device.

* * * * *